US011369141B2

(12) United States Patent
Liu

(10) Patent No.: US 11,369,141 B2
(45) Date of Patent: Jun. 28, 2022

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 245 days.

(21) Appl. No.: 16/899,604

(22) Filed: Jun. 12, 2020

(65) Prior Publication Data

US 2021/0092999 A1 Apr. 1, 2021

(30) Foreign Application Priority Data

Sep. 26, 2019 (CN) ..... 201910919886.2
Sep. 26, 2019 (CN) ..... 201921620723.6

(51) Int. Cl.
*A24F 40/40* (2020.01)

(52) U.S. Cl.
CPC ..... *A24F 40/40* (2020.01)

(58) Field of Classification Search
CPC ..... A24F 40/40; A24F 40/42; A24F 40/44; A24F 40/46; A24F 40/50; A24F 40/57; A24F 40/60; A24F 40/65; A24F 40/95
USPC ..... 131/329
See application file for complete search history.

(56) References Cited

U.S. PATENT DOCUMENTS 10,537,138 B2 * 1/2020 Li ..... A24F 40/42
10,806,186 B2 * 10/2020 Liu ..... A24F 40/485
11,071,328 B2 * 7/2021 Liu ..... A24F 7/02
11,076,643 B2 * 8/2021 Liu ..... A24F 40/42
11,089,821 B2 * 8/2021 Liu ..... A24F 40/40
2016/0000145 A1 * 1/2016 Liu ..... A24F 40/40 131/329
2019/0069598 A1 * 3/2019 Liu ..... A24F 40/46
2019/0133189 A1 * 5/2019 Chen ..... A24F 40/40
2020/0196677 A1 * 6/2020 Liu ..... A61M 15/06
2020/0315262 A1 * 10/2020 Liu ..... A61M 11/042
2020/0359705 A1 * 11/2020 Liu ..... A24F 40/10
2021/0045444 A1 * 2/2021 Liu ..... A24F 40/50

* cited by examiner

*Primary Examiner* — Harshad C Patel
(74) *Attorney, Agent, or Firm* — Matthias Scholl P.C.; Matthias Scholl

(57) ABSTRACT

An electronic cigarette including a mouthpiece assembly, an atomization assembly, and a base assembly. The mouthpiece assembly and the base assembly are disposed on two ends of the atomization assembly, respectively. The mouthpiece assembly includes a mouthpiece; a mouthpiece base; a movable cover; and a slidable block. The atomization assembly includes a seal gasket; a first permanent seat; a first seal ring; a glass tube; a second seal ring; an elastic sealing device including a connection bolt, a seal sleeve, a spring, and a second permanent seat; and an atomizer. The base assembly includes an airflow regulation ring; a fixed ring; a joint; an insulation ring; and a base. The mouthpiece base is connected to the slidable block. The mouthpiece base and the slidable block are disposed on two sides of the movable cover, respectively. The mouthpiece is in threaded connection to the mouthpiece base.

1 Claim, 6 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201910919886.2 filed Sep. 26, 2019 and to Chinese Patent Application No. 201921620723.6 filed Sep. 26, 2019. The contents of all of the aforementioned applications, including any intervening amendments thereto, are incorporated herein by reference. Inquiries from the public to applicants or assignees concerning this document or the related applications should be directed to: Matthias Scholl Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid.

Conventionally, the e-liquid filling hole of the electronic cigarettes is directly disposed on the wall surface of the atomizer, and the c-liquid filling hole is not properly sealed, so that the e-liquid tends to leak when replacing the atomizer.

SUMMARY

The disclosure provides an electronic cigarette comprising a mouthpiece assembly, an atomization assembly, and a base assembly; the mouthpiece assembly and the base assembly are disposed on two ends of the atomization assembly, respectively.

The mouthpiece assembly comprises a mouthpiece; a mouthpiece base; a movable cover; and a slidable block. The atomization assembly comprises a seal gasket; a first permanent seat; a first seal ring; a glass tube; a second seal ring; an elastic sealing device comprising a connection bolt, a seal sleeve, a spring, and a second permanent seat; and an atomizer.

The base assembly comprises an airflow regulation ring; a fixed ring; a joint; an insulation ring; and a base.

The mouthpiece base is connected to the slidable block; the mouthpiece base and the slidable block are disposed on two sides of the movable cover, respectively; the mouthpiece is in threaded connection to the mouthpiece base.

The seal gasket is disposed on the first permanent seat; the first permanent seat comprises a first annular groove and the first seal ring is embedded in the first annular groove; the seal gasket comprises an e-liquid filling hole covered by the movable cover; the movable cover is movable with respect to the seal gasket to cover or expose the e-liquid filling hole; the seal sleeve and the spring encircle the connection bolt, and the seal sleeve is disposed between the spring and the connection bolt; the connection bolt encircled by the seal sleeve and the spring is directly connected to the second permanent seat; the second permanent seat comprises a second annular groove and the second seal ring is disposed in the second annular groove; the glass tube is disposed on the second permanent seat; two ends of the glass tube are in threaded connection to the first permanent seat and the second permanent seat, respectively; the second permanent seat comprises a chamber and the atomizer is disposed in the chamber; the slidable block comprises a convex edge and the first permanent seat comprises an orbital groove; the convex edge matches the orbital groove to fix the slidable block on the first permanent seat.

The joint is encompassed by the insulation ring; the joint and the insulation ring are disposed on the base; the base comprises a flange and the fixed ring encircles the flange; the airflow regulation ring is disposed on the base; and the base is in threaded connection to the second permanent seat.

DETAILED DESCRIPTION

To further illustrate embodiments detailing an electronic cigarette are described below. It should be noted that the following embodiments are intended to describe and not to limit the disclosure.

Figure 1:
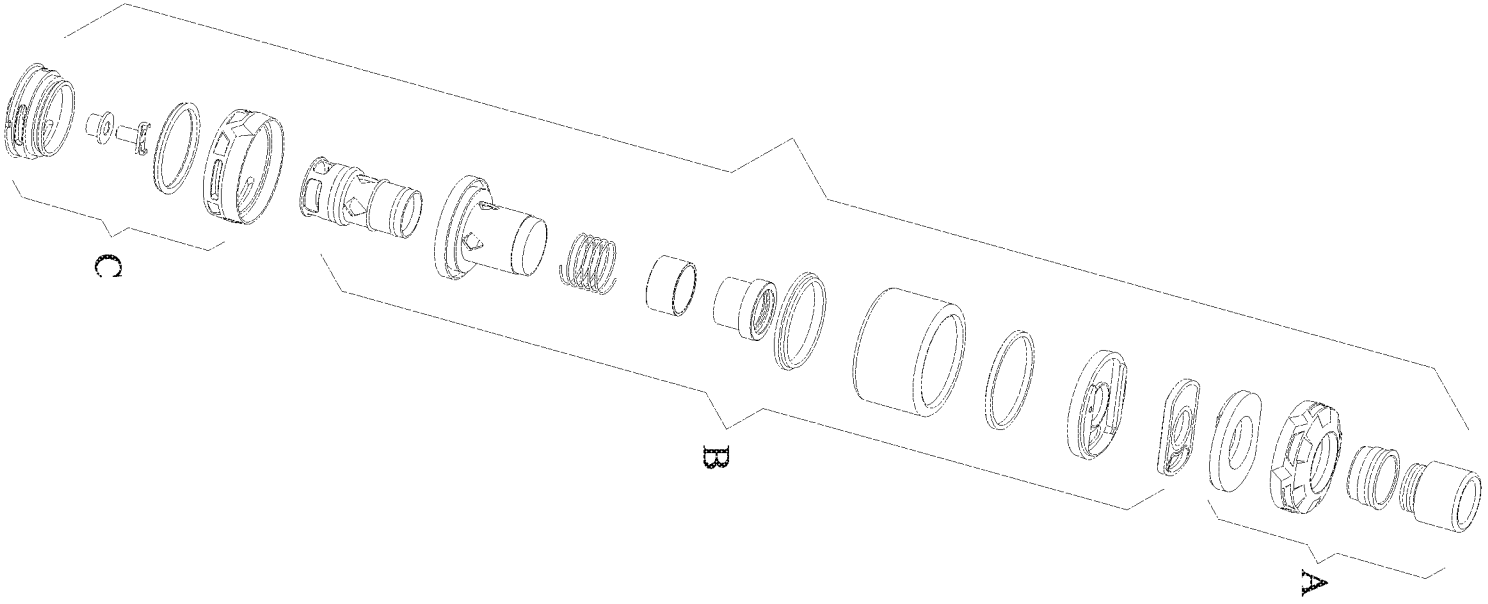
FIG. 1 is an exploded view of an electronic cigarette according to one embodiment of the disclosure.
Figure 2:
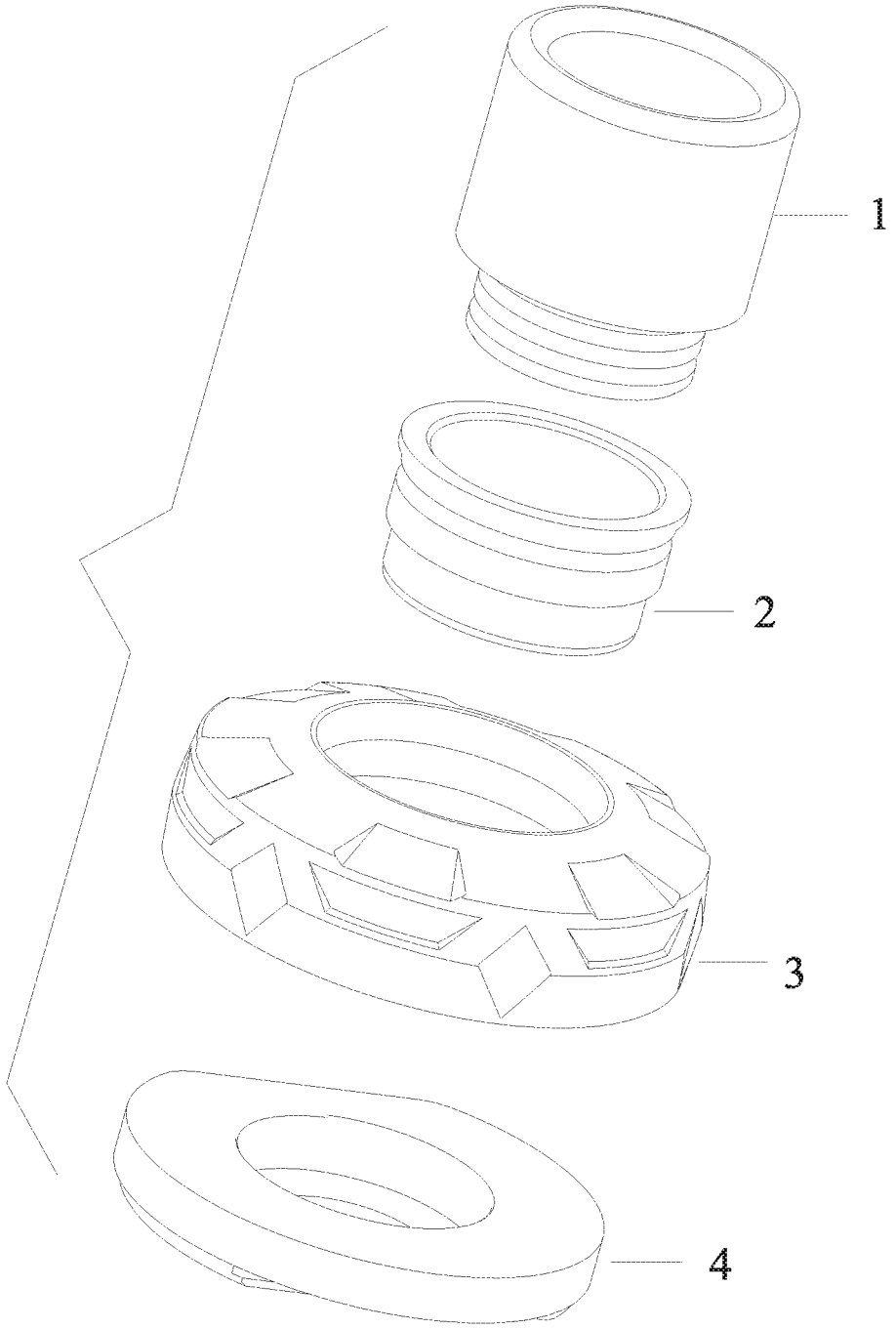
FIG. 2 is an exploded view of a mouthpiece assembly of an electronic cigarette according to one embodiment of the disclosure.
Figure 3:
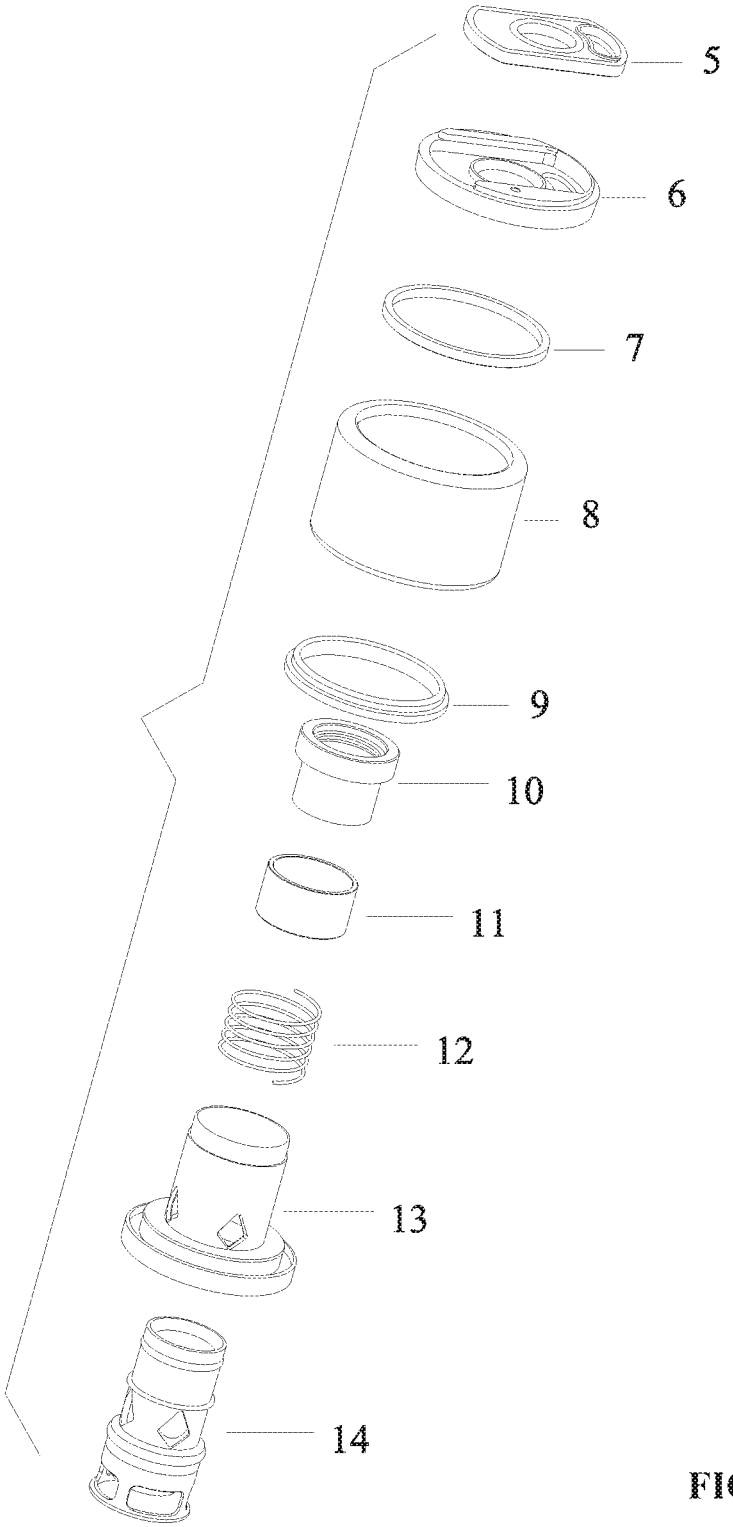
FIG. 3 is an exploded view of an atomization assembly of an electronic cigarette according to one embodiment of the disclosure.
Figure 4:
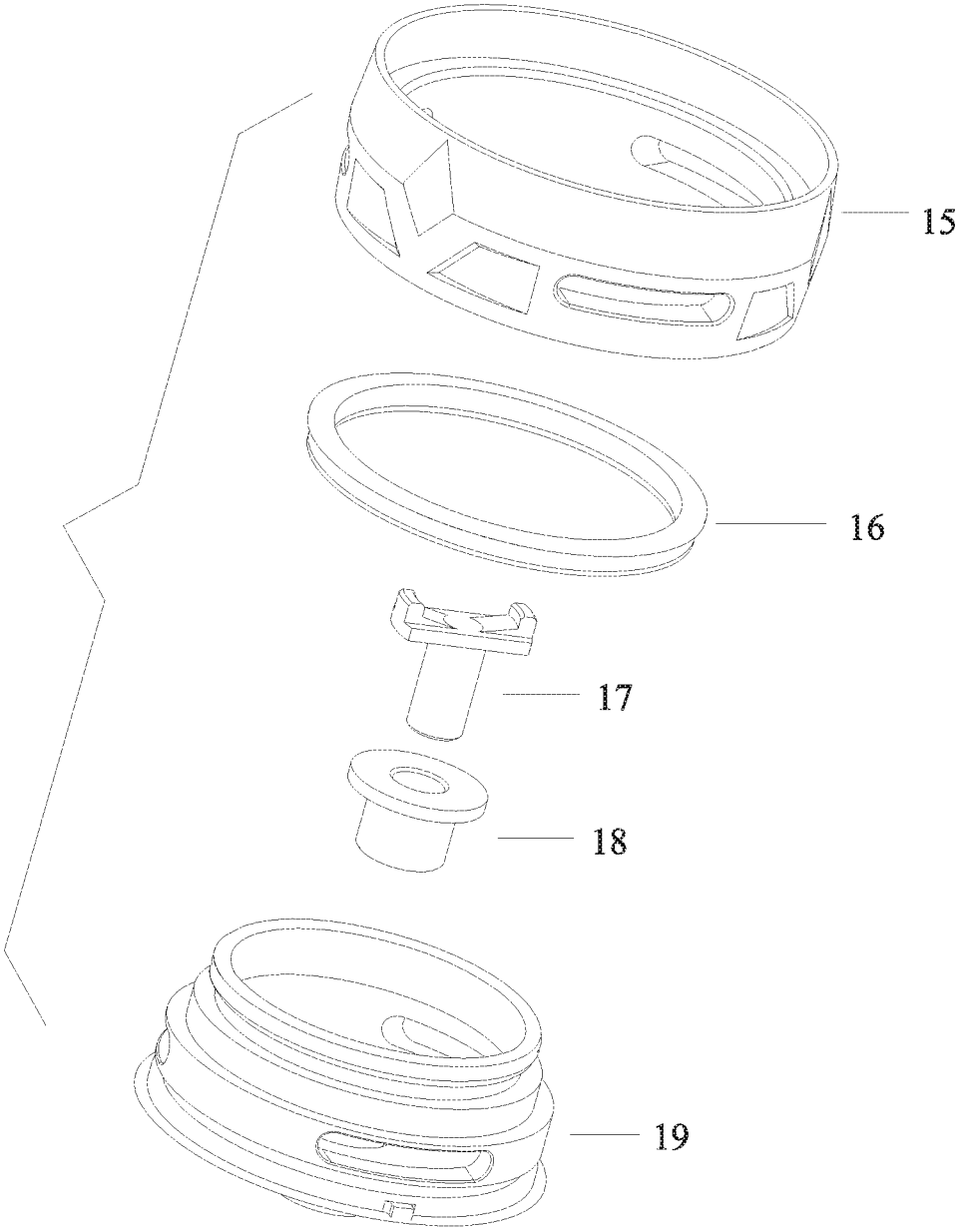
FIG. 4 is an exploded view of a base assembly of an electronic cigarette according to one embodiment of the disclosure.
Figure 5:
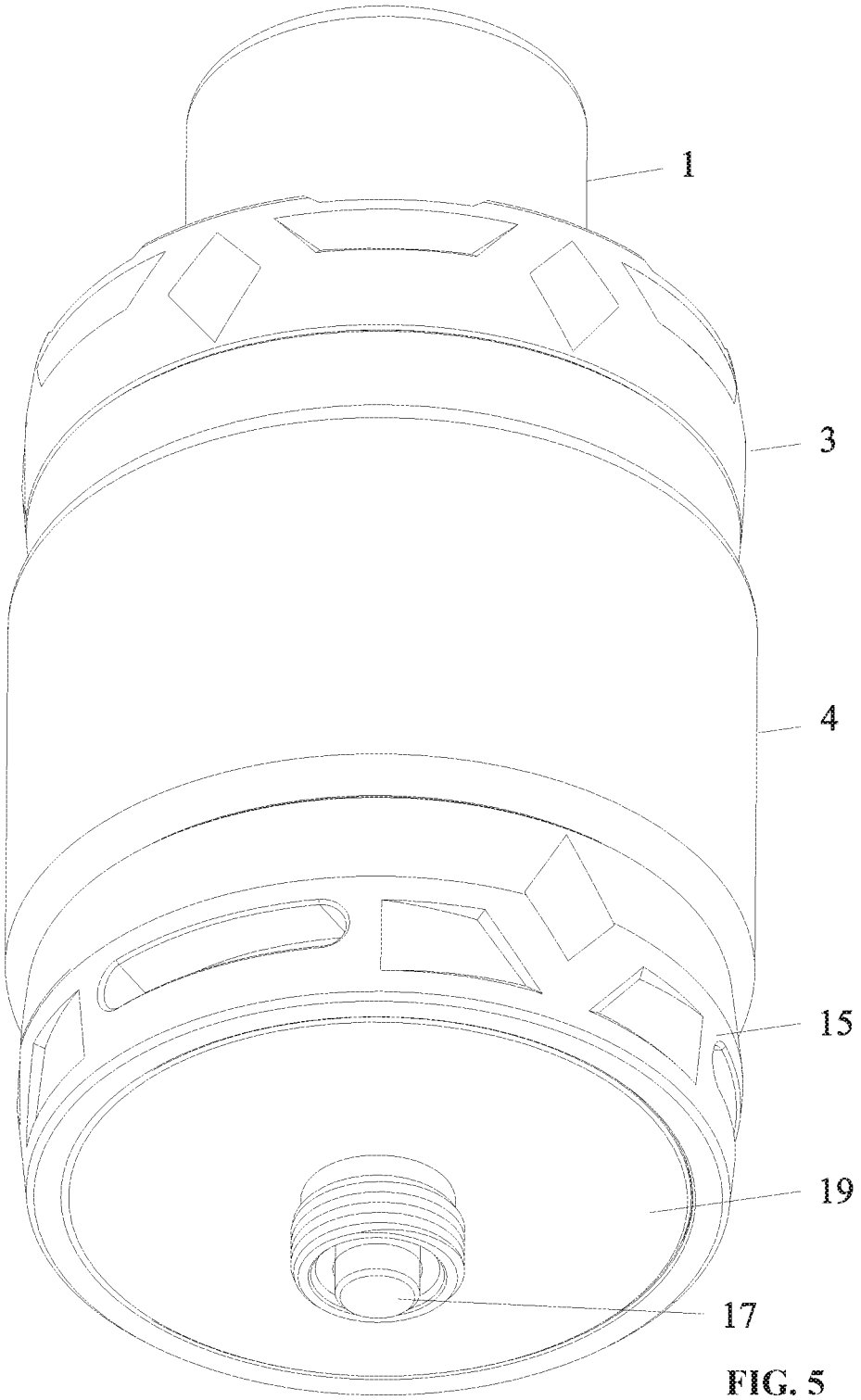
FIG. 5 is a front view of an electronic cigarette according to one embodiment of the disclosure.
Figure 6:
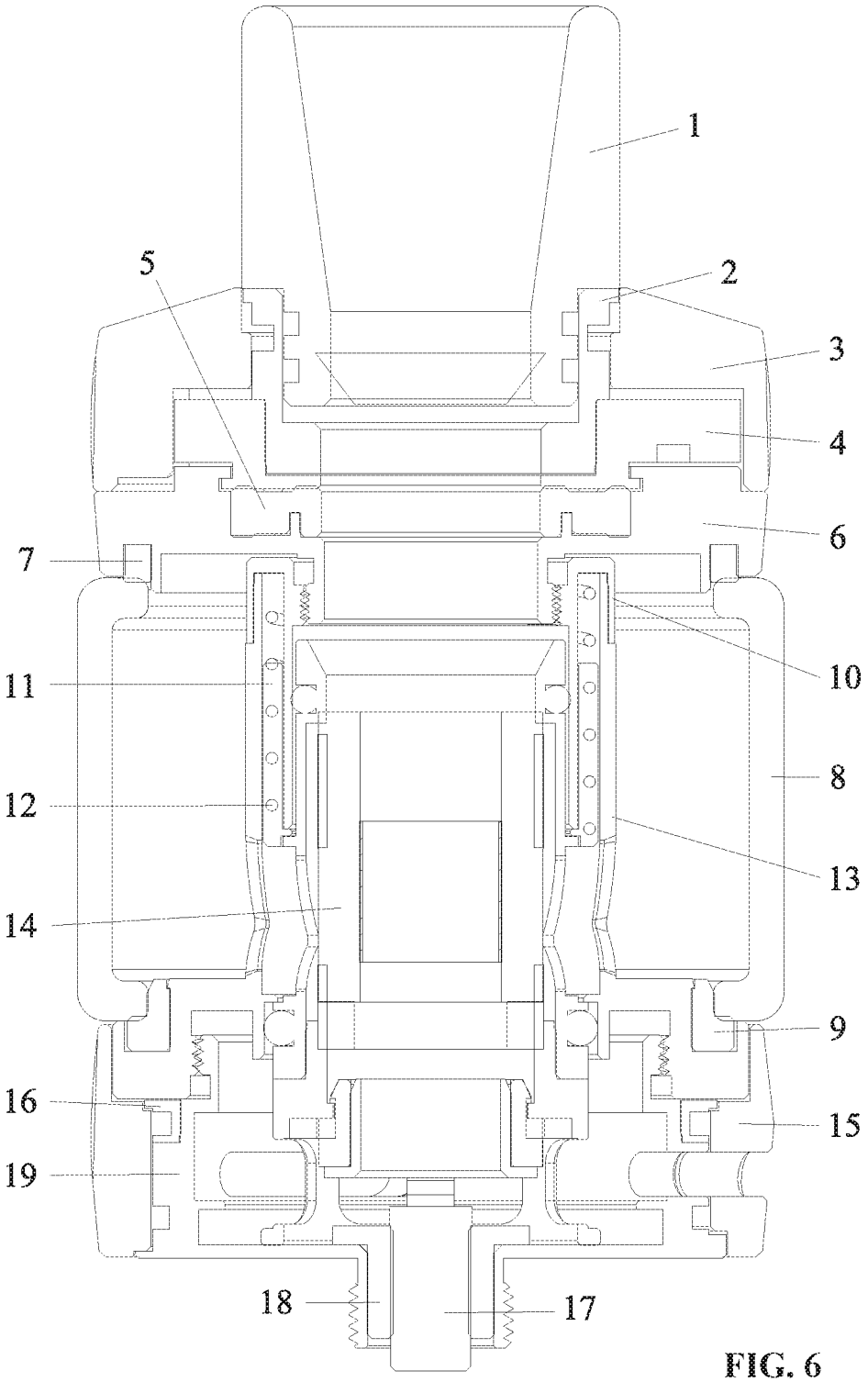
FIG. 6 is a sectional view of an electronic cigarette according to one embodiment of the disclosure.

As shown in FIGS. 1-6, an electronic cigarette comprises a mouthpiece assembly A, an atomization assembly B, and a base assembly C. The mouthpiece assembly and the base assembly are disposed on two ends of the atomization assembly, respectively.

The mouthpiece assembly A comprises a mouthpiece 1; a mouthpiece base 2; a movable cover 3; and a slidable block 4. The mouthpiece base 2 is connected to the slidable block 4; the mouthpiece base 2 and the slidable block 4 are disposed on two sides of the movable cover 3, respectively; the mouthpiece 1 is in threaded connection to the mouthpiece base 2.

The atomization assembly B comprises a seal gasket 5; a first permanent seat 6; a first seal ring 7; a glass tube 8; a second seal ring 9; an elastic sealing device comprising a connection bolt 10, a seal sleeve 11, a spring 12, and a second permanent seat 13; and an atomizer 14.

The seal gasket 5 is disposed on the first permanent seat 6; the first permanent seat 6 comprises a first annular groove and the first seal ring 7 is embedded in the first annular groove; the seal sleeve 11 and the spring 12 encircle the connection bolt 10, and the seal sleeve H is disposed between the spring 12 and the connection bolt 10; the connection bolt 10 encircled by the seal sleeve 11 and the spring 12 is directly connected to the second permanent seat 13; the second permanent seat 13 comprises a second annular groove and the second seal ring 9 is disposed in the second annular groove; the glass tube 8 is disposed on the second permanent seat 13; two ends of the glass tube 8 are in threaded connection to the first permanent seat 6 and the second permanent seat 13, respectively; the second permanent seat 13 comprises a chamber and the atomizer 14 is disposed in the chamber; the slidable block 4 comprises a convex edge and the first permanent seat 6 comprises an orbital groove; the convex edge matches the orbital groove to fix the slidable block 4 on the first permanent seat 6.

When the atomizer 14 is inserted into the chamber of the second permanent seat 13, the spring 12 is stressed to push away the seal sleeve 11, so that the e-liquid inlet of the second permanent seat 13 is exposed, and the e-liquid enters into the atomizer 14. When the atomizer 14 is withdrawn from the second permanent seat 13, the spring 12 resets, and the seal sleeve 11 returns to its original position to block the e-liquid thereby preventing the leakage of the e-liquid.

The mouthpiece assembly is disposed on the atomization assembly. The convex edge of the slidable block 4 of the mouthpiece assembly is embedded into the orbital groove of the first permanent seat 6 to fix the mouthpiece assembly on the atomization assembly. The seal gasket 5 comprises an e-liquid filling hole covered by the movable cover 3. The movable cover 3 is movable with respect to the seal gasket 5. When the movable cover 3 is lifted, the e-liquid filling hole of the seal gasket 5 is exposed and the e-liquid can be injected to the atomizer.

The base assembly C comprises an airflow regulation ring 15; a fixed ring 16; a joint 17; an insulation ring 18; and a base 19. The joint 17 is encompassed by the insulation ring 18; the joint 17 and the insulation ring 18 are disposed on the base 19; the base 19 comprises a flange and the fixed ring 16 encircles the flange; the airflow regulation ring 15 is disposed on the base 19; and the base 19 is in threaded connection to the second permanent seat 13.

It will be obvious to those skilled in the art that changes and modifications may be made, and therefore, the aim in the appended claims is to cover all such changes and modifications.

What is claimed is:

1. A device, comprising: a mouthpiece assembly, an atomization assembly, and a base assembly; the mouthpiece assembly and the base assembly being disposed on two ends of the atomization assembly, respectively;

the mouthpiece assembly comprising:

1) a mouthpiece;
2) a mouthpiece base;
3) a movable cover; and
4) a slidable block;

the atomization assembly comprising:

5) a seal gasket;
6) a first permanent seat;
7) a first seal ring;
8) a glass tube;
9) a second seal ring;
10) an elastic sealing device comprising a connection bolt, a seal sleeve, a spring, and a second permanent seat; and
11) an atomizer;

the base assembly comprising:

12) an airflow regulation ring;
13) a fixed ring;
14) a joint;
15) an insulation ring; and
16) a base;

wherein:

the mouthpiece base is directly connected to the slidable block; the mouthpiece base and the slidable block are disposed on two sides of the movable cover, respectively; the mouthpiece is in threaded connection to the mouthpiece base;

the seal gasket is disposed on the first permanent seat; the first permanent seat comprises a first annular groove and the first seal ring is embedded in the first annular groove; the seal gasket comprises an e-liquid filling hole covered by the movable cover; the movable cover is movable with respect to the seal gasket to cover or expose the c-liquid filling hole;

the seal sleeve and the spring encircle the connection bolt, and the seal sleeve is disposed between the spring and the connection bolt; the connection bolt encircled by the seal sleeve and the spring is directly connected to the second permanent seat;

the second permanent seat comprises a second annular groove and the second seal ring is disposed in the second annular groove; the glass tube is disposed on the second permanent seat; two ends of the glass tube are in threaded connection to the first permanent seat and the second permanent seat, respectively;

the second permanent seat comprises a chamber and the atomizer is disposed in the chamber;

the slidable block comprises a convex edge and the first permanent seat comprises an orbital groove; the convex edge matches the orbital groove to fix the slidable block on the first permanent seat; and the joint is encompassed by the insulation ring; the joint and the insulation ring are disposed on the base; the base comprises a flange and the fixed ring encircles the flange; the airflow regulation ring is disposed on the base; and the base is in threaded connection to the second permanent seat.

* * * * *